US009453373B2

(12) United States Patent
Shnell

(10) Patent No.: US 9,453,373 B2
(45) Date of Patent: Sep. 27, 2016

(54) SYSTEM AND METHOD FOR DRILLING IN ROCK USING MICROWAVES

(71) Applicant: James H. Shnell, Santa Ana, CA (US)

(72) Inventor: James H. Shnell, Santa Ana, CA (US)

( * ) Notice: Subject to any disclaimer, the term of this patent is extended or adjusted under 35 U.S.C. 154(b) by 594 days.

(21) Appl. No.: 13/828,298

(22) Filed: Mar. 14, 2013

(65) Prior Publication Data

US 2014/0041940 A1 Feb. 13, 2014

Related U.S. Application Data

(60) Provisional application No. 61/681,463, filed on Aug. 9, 2012.

(51) Int. Cl.
*E21B 7/14* (2006.01)
*H05B 6/80* (2006.01)

(52) U.S. Cl.
CPC .. *E21B 7/14* (2013.01); *H05B 6/80* (2013.01)

(58) Field of Classification Search
CPC ..... H05B 6/64; H05B 6/80; E21B 7/14; E21B 7/15
See application file for complete search history.

(56) References Cited

U.S. PATENT DOCUMENTS 5,003,144 A 3/1991 Lindroth et al.
5,449,889 A * 9/1995 Samardzija ..... 219/695
6,114,676 A 9/2000 Jerby et al.
8,393,410 B2 3/2013 Woskov et al.
8,550,182 B2 * 10/2013 Ouellet et al. ..... 175/11
2009/0321132 A1 * 12/2009 Ouellet et al. ..... 175/11
2010/0252324 A1 * 10/2010 Woskov et al. ..... 175/11
2012/0261188 A1 * 10/2012 Zediker et al. ..... 175/15
2014/0008968 A1 * 1/2014 Moeny ..... 307/2
2014/0021171 A1 * 1/2014 Jerby et al. ..... 219/76.1
2015/0176333 A1 * 6/2015 Hanback ..... E21B 7/15

FOREIGN PATENT DOCUMENTS

DE 10 2007 060409 A1 6/2009
WO 2008/011729 A1 1/2008

OTHER PUBLICATIONS

International Search Report issued on Sep. 2, 2014 for International Application No. PCT/US2013/054142, in 10 pages.
M. Asgeirsdottir, "Changes and evolution of rock physical properties with temperature" at http://hraun.vedur.is/ja/skyrslur/prenlab/ed-pren2/all/node35.html, 1999.
M. Asgeirsdottir, "Fracture toughness of heat-treated Icelandic basalt" at http://hraun.vedur.is/ja/skyrslur/prenlab/ed-pren2/all/node36.html, 1999.

(Continued)

*Primary Examiner* — Elizabeth Gitlin
(74) *Attorney, Agent, or Firm* — Knobbe, Martens, Olson & Bear LLP

(57) ABSTRACT

An apparatus for drilling a wellbore in a material, such as rock, is provided. The apparatus can include a microwave source, a first fluid source, and a second fluid source. The microwave source can be configured to transmit microwave energy to a surface of the material to alter the material. The first fluid source can be configured to emit a first fluid to the surface of the material to alter the material. The first fluid can be substantially absorptive to the microwave energy. The second fluid source can be configured to emit a second fluid to the surface of the material to flush the first fluid from the surface of the material. The second fluid can be substantially transparent to the microwave energy.

15 Claims, 5 Drawing Sheets

(56) References Cited

OTHER PUBLICATIONS

M. Asgeirsdottir, "Crack linkage and enhanced fluid permeability in heat-treated Icelandic basalt" at http://hraun.vedur.is/ja/skyrslur/prenlab/ed-pren2/all/node37.html, 1999.

P.G. Chamberlain and D.P. Lindroth, "Thermal Fragmentation and Excavation" (in H.L. Hartman, Sr. Ed., v. 2, SME Mining Engineering Handbook, Society for Mining, Metallurgy and Exploration, Inc.© 1992, Section 22.9.4, pp. 2037-2040).

M. Violay et al., "Brittle Ductile Transition in Experimentally Deformed Basalt under Oceanic Crust Conditions" (abstract), Geophysical Research Abstract, vol. 11, EGU 2009-5507-7, 2009 EGU General Assembly 2009.

* cited by examiner

SYSTEM AND METHOD FOR DRILLING IN ROCK USING MICROWAVES

CROSS-REFERENCE TO RELATED APPLICATIONS

This application claims the benefit of priority to U.S. Provisional Appl. No. 61/681,463, filed on Aug. 9, 2012, and incorporated in its entirety by reference herein.

BACKGROUND

1. Field of the Application

The present application relates generally to a new method for drilling using microwave energy.

2. Description of the Related Art

The current state of the art in drilling rock utilizes rotating drilling bits to fracture rock into small pieces, which are then removed from a hole by a circulating fluid. This process takes time to drill any distance, and the harder the rock is the longer it takes to drill that distance. In order to speed up drilling in harder rock, harder drill bits are used. Very hard rock is drilled using bits that are not only made of hard metals, but that also have diamond fragments glued to the cutting faces of the drill bit (e.g., the rollers of the drill bit). Such drill bits nevertheless wear out regularly when used to drill very hard rock, and have to be replaced, a process which takes additional time. The drill string has to be removed from the borehole by disassembling it, so that the worn-out bit can be replaced, and then the new bit is lowered into the borehole by reassembling the drill string. The problems and delays are made worse if the rock is hot, because the heat causes the diamond fragments to become detached from the bit, so that the bit becomes worn out even sooner. The heat can also cause other malfunctions in the drilling of the borehole, and can complicate the collection of data regarding the progress of the drilling, making it more difficult to control the drilling.

Some recent studies have analyzed the use of flame-jets or lasers to heat the surface of the rock to be removed, causing the spalling of the rock surface. Such methods may not work effectively, depending on the characteristics of the rock that is being drilled. For example, some kinds of rock are not susceptible to spalling.

SUMMARY

According to some embodiments of the present disclosure, an apparatus for drilling a wellbore in a material comprising rock is disclosed. The apparatus may comprise: a microwave source, a first fluid source, and a second fluid source. The microwave source can be configured to transmit microwave energy to a surface of the material, and the microwave energy can be configured to alter the material. The first fluid source can be configured to emit a first fluid to the surface of the material, and the first fluid can be configured to alter the material. The first fluid may be substantially absorptive to the microwave energy. The second fluid source can be configured to emit a second fluid to the surface of the material. The second fluid can be configured to flush the first fluid from the surface of the material, and the second fluid can be substantially transparent to the microwave energy.

In some embodiments, the microwave energy is configured to alter the material by at least one of the group consisting of: heating, softening, increasing fluid permeability, weakening, fracturing, melting, and cracking the material. In some embodiments, the microwave source comprises at least one microwave generator and at least one waveguide. The at least one waveguide can be configured to direct the microwave energy from the at least one microwave generator towards the material. Moreover, in some embodiments, the at least one microwave generator can be configured to be within the wellbore, and the apparatus may further comprise a protective structure positioned between the at least one waveguide and the surface of the material. The protective structure can be configured to protect the at least one microwave source and the at least one waveguide from contact with the surface of the material, and the protective structure can be substantially transparent to the microwave energy.

According to some embodiments, the microwave source comprises one or more microwave amplification by stimulated emission of radiation (MASER) devices. The microwave source of some embodiments may comprise a plurality of MASER devices configured to generate microwave energy having different wavelengths. The first fluid may comprise seawater in some embodiments. In some embodiments, the first fluid may be configured to alter the material by at least one of the group consisting of: cooling, weakening, fracturing, cutting, and cracking the material. The first fluid may transport debris away from the surface of the material. In some embodiments, the first fluid source comprises at least one nozzle configured to emit the first fluid at sufficiently high pressures such that the first fluid cuts the surface of the material.

According to some embodiments, the second fluid may comprise nitrogen. In some embodiments, the second fluid source may comprise at least one nozzle configured to emit the second fluid at the critical pressure of the second fluid. Some embodiments may include a controller configured to actuate the first fluid source and to actuate the second fluid source. The controller may be further configured to actuate the microwave source while the second fluid source is actuated and to not actuate the microwave source unless the second fluid source is actuated.

According to some embodiments of the present disclosure, a method is disclosed for drilling a wellbore in a material comprising rock. The method can comprise directing microwave energy at a surface of the material, directing a first fluid to impinge the surface of the material, directing a second fluid to impinge the surface of the material and to flush the first fluid from the surface of the material. The first fluid may be substantially absorptive to the microwave energy, and the second fluid may be substantially transparent to the microwave energy.

In some embodiments, directing the microwave energy can be performed concurrently with the step of directing the second fluid. In some embodiments, directing the microwave energy to a first region of the surface may not be performed concurrently with the step of directing the first fluid to the first region of the surface. In some embodiments, directing the first fluid comprises directing the first fluid at a first region of the surface, and directing the second fluid comprises subsequently directing the second fluid at the first region. In some embodiments, directing the first fluid comprises directing the first fluid at a first region of the surface, and said directing the second fluid comprises concurrently directing the second fluid at a second region of the surface different from the first region.

In some embodiments, directing the microwave energy may comprise altering the material by at least one of the group consisting of: heating, softening, increasing fluid permeability, weakening, fracturing, melting, and cracking the material. According to some embodiments, directing the first fluid can comprise altering the material by at least one of the group consisting of: cooling, weakening, fracturing, cutting, and cracking the material. In some embodiments, directing the first fluid may comprise transporting debris away from the surface of the material. Directing the first fluid source may, in some embodiments, comprise emitting the first fluid at sufficiently high pressures such that the first fluid cuts the surface of the material. In certain embodiments, the method further comprises forming a kerf by using the microwave energy to melt a band of rock in a perimeter of the wellbore and using the first fluid to force the melted rock into cracks in rock outside the wellbore.

These and other embodiments are described in greater detail below. However, a skilled artisan would recognize that undisclosed variations on these embodiments are easily achievable.

DETAILED DESCRIPTION

Figure 1:
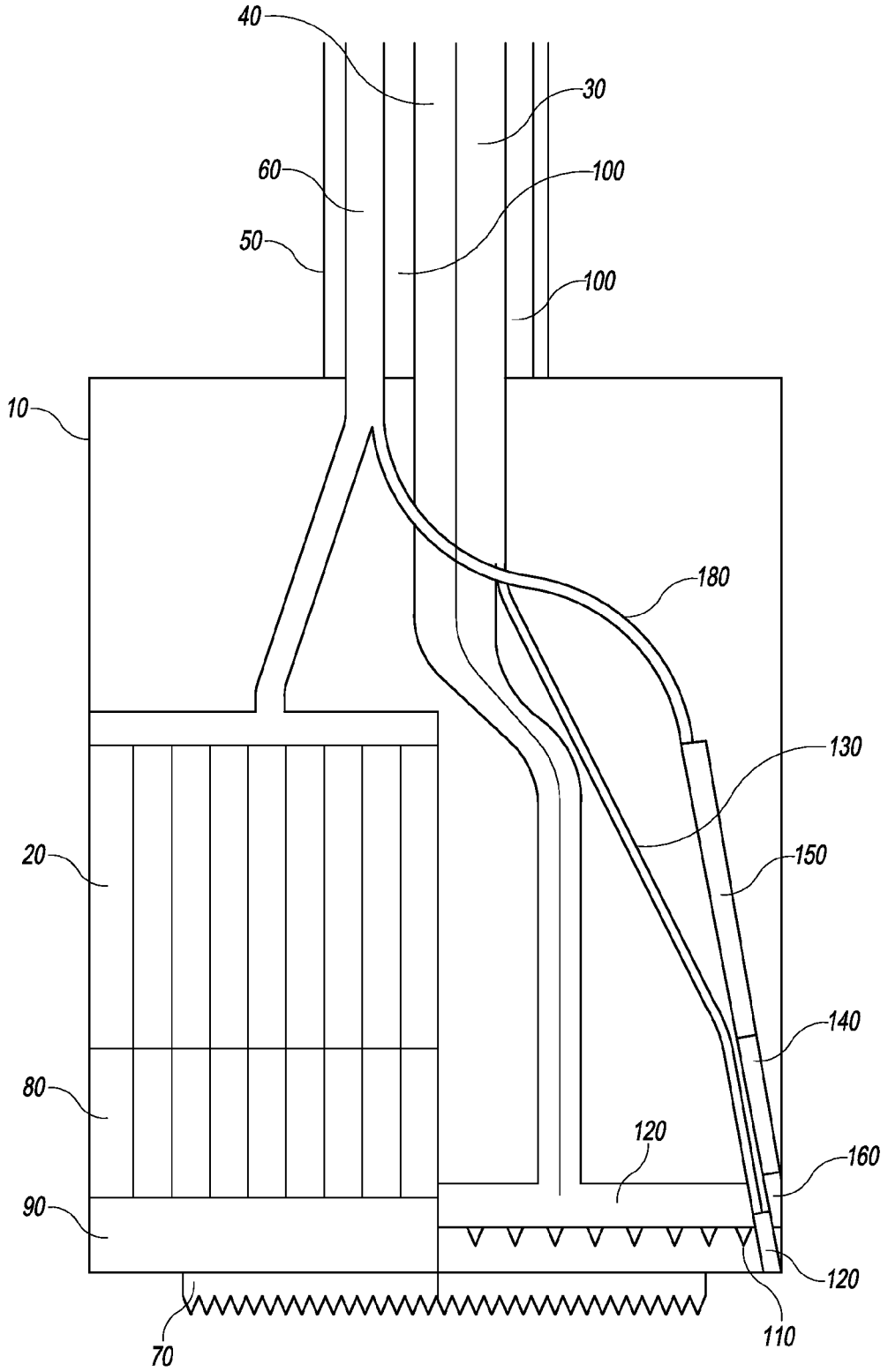
FIG. 1 is a cross-section schematic side view of an example drilling apparatus in accordance with certain embodiments described herein.

Certain embodiments described herein use microwave energy to create temperature fluctuations that induce cracks and structural changes in the part of the rock to be drilled, and/or to melt the rock, so that the rock can be reduced to small pieces and removed. Certain embodiments can increase the speed and decrease the cost of drilling such rock and can reduce the wear and tear on drill bits and related equipment.

Certain embodiments described herein relate generally to a new method for drilling in very hard rock. Such a method may be useful, for example, in drilling offshore, in the ocean floor beyond the continental shelf and the continental slope, where it is possible to find vast geothermal resources at temperatures of 500° C. or more. In certain areas of the ocean floor, such as areas near to oceanic rift zones, such temperatures may be reached by drilling less than 1,000 meters into the ocean floor. The ocean floor in such areas may be, however, predominantly composed of basalt and other very hard forms of igneous rock, and drilling such rock using conventional drilling methods is very slow, and results in much wear and tear on the drill bit and other pieces of equipment due to continuous rough contact with the rock. In drilling offshore, which generally requires drilling ships or platforms and other expensive equipment, the additional time necessary to drill very hard rock can be particularly expensive. In addition, much of the rock that is drilled using conventional methods on land is at a temperature of 250° C. or less. Drilling into rock at temperatures of 500° C. or more presents significant difficulties for conventional drilling methods.

Certain embodiments described herein can use microwaves to generate heat inside the rock to be drilled, causing the rock to fracture. This approach, in appropriate circumstances, can take the very high temperature of the rock and turn it from a problem into an advantage. The microwaves can penetrate the rock to a depth determined by the frequency of the microwaves and the properties of the rock, heating the rock in the inside as well as on the surface. The stresses created between the heated rock and the surrounding cold rock are independent of the volume of the heated rock. The stresses induce tensile and shear fractures, so the ability of microwaves to fracture rock does not depend on the compressive strength of the rock.

The hot inclusion in the rock can generate cracks, but the cracks are not necessarily in the inclusion; they may be in the boundary with the cooler rock. As discussed below, in certain embodiments, particularly embodiments involving offshore drilling, the drilling fluid can be seawater, which can act to chill the surface of the rock as well as acting as a drilling fluid. At depths, the temperature of ocean water may be as low as 3° C. If the new cracks are outside the hot inclusion and they fill with drilling fluid, and then the new cracks open up as the rock is chilled, the cracks can become hot inclusions in their own right, with the continued irradiation by microwaves heating the drilling fluid in or adjacent the cracks. The resulting rapid cooling by drilling fluid, followed by rapid heating by microwaves, can have the effect of a "thermal hammering" of the rock. This "hammering" effect may be accentuated if conditions cause the drilling to slow down, because the depth of penetration of the microwaves into the rock will give the system more opportunities to thermally "hammer" the rock. The intensity can be stepped up (or down, to slow the drilling) by a microprocessor or by the operator of the drilling system, thereby increasing (or decreasing) the amount of power the drilling system delivers to the microwave generating units.

This effect can be further controlled through adjustment of different microwave generating units that operate at different frequencies within a single drill bit or by switching one drill bit for another that has microwave generating units with different frequencies. If different microwave generating units in a particular drill bit are set to generate microwaves in different frequencies, then the frequencies of the microwaves generated by that drill bit can be adjusted by increasing the amount of power that can be supplied to generating units of one frequency and decreasing the amount of power that can be supplied to other generating units. The frequencies of the microwaves, and therefore the depth of the effectiveness of the microwaves, can be adjusted while the drilling continues, without having to stop and replace the whole bit.

In a separate effect, the microwaves can also cause the structure of the rock to weaken so that it can be more effectively broken up by other means. Increasing the temperature of the basalt into the range of 700° C. to 800° C. may in some respects further increase the fracturing and porosity of the rock.

The microwaves can penetrate the rock beyond the surface, to an extent determined by the frequency of the microwaves and the composition of the rock. The depth of penetration can enable the drill to build up the heat in the rock over time, rather than using just a single shot of radiation. This build up of heat can occur, for example, if the conditions are such that the distance that the microwaves penetrate into the rock is several times the depth of the rock that is removed in each turn of the drill bit, because a given volume of the rock will be irradiated several times before the drill bit reaches it and it is chilled by the drilling fluid and then (in some embodiments) crushed by the cutting surface. One objection that has been expressed in the past with respect to using lasers, microwaves, and other forms of energy to cause rocks to fracture has been the amount of energy that is needed in order to raise the temperature of the item to be irradiated. In this case, however, the pre-existing high temperature of the rock that is to be drilled, which is otherwise a problem, can be advantageously implemented in drilling the borehole. Rock located deeper beneath the surface is generally at a higher temperature than rock that is shallower. Therefore, significantly less energy may be needed from the microwave generating units to achieve the desired temperature in the rock. A greater amount of microwave energy can be utilized early in the drilling, because the rock at the top of the borehole may not be as hot, but the system may use less energy as it drills deeper, into hotter rock. Also, throughout the drilling the speed of penetration can be controlled by adjusting the amount of energy used, since more energy can heat the rock faster and speed up the penetration of the drill bit when the circumstances permit.

In certain embodiments, the system may have the ability to control the distribution of heat within the rock, and the temperature reached by the rock, by adjusting the power of the microwaves used, and the frequencies at which that power is used. Thus, the system can enable the drill bit to heat the rock to the appropriate temperature to fracture the rock, without exceeding that temperature. Such control of the temperature can be advantageous because at higher temperatures the rock can start to become ductile and can ultimately melt, which can defeat the objective of fracturing the rock.

Certain embodiments described herein can be equipped to monitor the cracking of the rock, the temperature of the rock, and the drilling fluid. Certain such embodiments advantageously enable more precise and effective use of the various methods of drilling by adjusting the functions of the drill bit, including the use of frequencies and power in the microwave units, cooling and pressure in the drilling fluid, and speed and direction of the rotation of the drill bit to optimize the drilling. Such equipment can include radar or sonar to scan the rock surface, and can include ground penetrating radar to acquire data on the condition of the rock below the rock surface. The ability to use a variety of modalities to break down the rock, instead of simply grinding or cutting it, reduces the amount of impact, and therefore the wear and tear, on the drill bit and other drilling equipment.

When drilling offshore in deep ocean locations using drill strings assembled from pipe to control and maneuver the drill bit, long delays are often created, when seeking to change the drill bit or make other changes, by the need to disassemble the drill string in order to retrieve the drill bit. In certain embodiments described herein, the drill bit can be suspended from the drilling platform or ship by cables, instead of by a drill string assembled from drill pipe. In such embodiments, water (or other drilling fluid) can be supplied to the drill bit by one or more hoses, and electricity can be supplied to the microwave generators (and/or MASERs) by electric cables. When it is desirable to change the drill bit or otherwise to retrieve the drill bit, such embodiments can retrieve the drill bit by retracting and rolling up the cables and hoses, and can put the new or changed drill bit back into the borehole by unrolling and extending the cables and hoses without the slow process of disassembling and reassembling the drill string.

In most current drilling, the rotation of the drill bit is caused by the rotation of the drill string to which the drill bit is attached. In certain embodiments described herein (including certain embodiments that use cables to suspend the drill bit instead of a drill string), the cutting and grinding can be performed by rollers and/or cones in the bottom or the side of the drill bit. The rollers and/or cones can be connected to one or more motors in the drill bit causing the rollers and/or cones to rotate like wheels, thus causing the drill bit to rotate. In certain embodiments, the direction of the rotation of the rollers or cones can be reversible, so that the rotation of the drill bit can be reversed when appropriate in order to avoid excessive rotation of any part of the equipment connected to the drill bit.

Certain embodiments described herein relate generally to a new method for drilling in very hard rock that may also be very hot. Certain embodiments can use microwave generating units (which may include MASERs) to generate heat inside the rock to be drilled, causing the rock to fracture in some embodiments or functions, and to melt in others. Microwaves can also cause the structure of the rock to weaken, so it can be more effectively broken up by other means. In certain embodiments, drilling fluid (which may be seawater, if a well is being drilled offshore) can be used to chill the hot rock and open up cracks in the rock while also cooling the drill bit and related equipment and/or to jack open cracks with pressure and/or to cut the rock, using high-pressure jets. Certain embodiments also use cutting and grinding surfaces or rollers on the face of the drill bit to work with the microwaves and drilling fluid, and certain embodiments also incorporate one or more gage cutters to cut a kerf around the surface of the rock to be drilled.

FIG. 1 schematically illustrates an example apparatus 10 for drilling a wellbore in a material comprising rock in accordance with certain embodiments described herein. The apparatus 10 comprises a microwave source 20 configured to transmit microwave energy to a surface of the material. The microwave energy is configured to alter the material. The apparatus 10 further comprises a first fluid source 30 configured to emit a first fluid to the surface of the material. The first fluid is configured to alter the material and the first fluid is substantially absorptive to the microwave energy. The apparatus 10 further comprises a second fluid source 40 configured to emit a second fluid to the surface of the material. The second fluid is configured to flush the first fluid from the surface of the material, and the second fluid is substantially transparent to the microwave energy.

In certain embodiments, a drill string 50 is attached to the apparatus 10, and the drill string 50 may comprise cables or pipes. When drilling offshore in deep ocean locations using drill strings assembled from pipe to control and maneuver the apparatus 10, long delays are often created, when seeking to change the drill bit or make other changes, by the need to disassemble the drill string in order to retrieve the apparatus 10. Accordingly, in certain embodiments described herein, the drill bit or apparatus 10 can be suspended from the drilling platform or ship by a drill string 50 in the form of cables, instead of by a drill string assembled from drill pipe. In such embodiments, water (or other drilling fluid) can be supplied to the drill bit by the first fluid source 30 in the form of one or more hoses, and electricity can be supplied to the microwave source 20, such as microwave generators (and/or MASERs), by an electric power line 60. When it is desirable to change the drill bit or otherwise to retrieve the apparatus 10, such embodiments can retrieve the apparatus 10 by retracting and rolling up the cables and hoses of the drill string 50, and can put the new or changed drill bit back into the borehole by unrolling and extending the cables and hoses of drill string 50 without the slow process of disassembling and reassembling the drill strings formed of pipes.

In many drilling operations, the rotation of the apparatus 10 or drill bit is caused by the rotation of the drill string 50 to which the apparatus 10 is attached. In certain embodiments described herein (including certain embodiments that use cables to suspend the drill bit instead of pipes and wires, cables, and hoses to control the drilling and provide electricity, fluids, and other operational utilities of the drill bit), the cutting and grinding can be performed by cutting structures 70, such as rollers and/or cones, in the bottom or the side of the drill bit. The rollers and/or cones can be connected to one or more motors in the apparatus 10 causing the rollers and/or cones to rotate like wheels, thus causing the apparatus 10 to rotate. In certain embodiments, the direction of the rotation of the rollers or cones can be reversible, so that the rotation of the apparatus 10 can be reversed when appropriate in order to avoid excessive twisting of cables, wires and hoses, or otherwise excessive rotation of any part of the equipment connected to the apparatus 10.

The microwaves generated by the microwave source 20 can also cause the structure of the rock to weaken so that it can be more effectively broken up by other means. Increasing the temperature of materials, such as basalt, into the range of about 700° C. to about 800° C. may in some respects further increase the fracturing and porosity of the rock material. In some rock materials, temperatures of about 400° C. to about 600° C. can achieve fracturing of the material to facilitate its removal from a borehole. Under certain circumstances, the drilling of a well that is 1 meter in diameter, with a rate of penetration of 10 meters per hour, can consume 5 to 7 megawatt-hours of electricity per hour. In certain embodiments, each microwave source 20 can use up to 2 megawatts of power to generate microwaves having a frequency of 2 GHz to over 200 GHz.

The microwave source 20 can be configured to alter the material of the rock surface by at least one of the following: heating, softening, increasing fluid permeability, weakening, fracturing, melting, and cracking the material.

The microwave source 20 can comprise one or more microwave generating units, which may include microwave amplification by stimulated emission of radiation (MASER) devices, configured to generate heat inside or under the surface of a rock material to be drilled by the apparatus 10. The resulting heat may cause the rock material to fracture, at least partially melt, or simply weaken structurally. In some embodiments, the microwave source 20 comprises a plurality of MASER devices configured to generate microwave energy having different wavelengths. The one or more microwave generation units can be outside of the drill bit, and the microwaves conducted to the drill bit and into the rock surface by waveguides 80 that run from the one or more microwave generation units to the drill bit. In the alternative, one or more microwave generation units can be located within the borehole (e.g., in the drill bit or in proximity to the drill bit) with shorter waveguides 80 that direct the microwaves into the rock to be drilled. In certain embodiments, the microwave source 20 is used in conjunction with the cutting structures 70 and the first fluid from the first fluid source 30 to cut or remove material in drilling the wellbore.

In using microwave energy in connection with the drilling of rock, the rate of penetration through the rock can (within certain limits) vary in proportion to the amount of microwave energy used for the drilling. The ability to transmit and apply large amounts of energy to drilling may become constrained, however, by the size of the borehole. Accordingly, certain embodiments can utilize one or more units providing microwave amplification by stimulated emission of radiation ("MASERs"), such as gyrotrons, to provide increased amounts of microwave energy for drilling. For example, such microwave amplifying units can advantageously be used in circumstances in which the rate of drilling is otherwise limited by the amount of microwave energy that can be transmitted to the rock. The MASERs may use continuous wave operation or pulsed operation, depending on the particular drilling application. If pulsed operation is used, multiple MASERs may be synchronized to use a single waveguide (thus saving space) but can maintain separation between the pulses. In certain embodiments, the pulse widths, duty cycle, and other parameters of pulsed separation can be selected in order to maximize the amount of energy that can be applied to the rock at the bottom of the borehole, subject to the limitations of the waveguide that is used. For example, pulsing the microwave source 20 can increase the instantaneous power to be about 5 to 7 megawatts, an order of magnitude higher than the time-averaged power (e.g., power generated by a continuous-wave or non-pulsed source).

The microwave energy from the microwave source 20 can be directed toward the surface of a rock material by one or more waveguides 80. In some embodiments, the microwave source 20 comprises the one or more microwave generators and the at least one waveguide configured to direct microwave energy produced by the generator towards the material of the rock surface or beneath the surface. The microwave source 20 may be located, in whole or in part, within the apparatus 10, outside the apparatus 10 but still within the borehole, or altogether outside the borehole. Shorter waveguides 80 can be used when the microwave source 20 is located within the apparatus 10 as shown in FIG. 1. In certain embodiments, the waveguide may be filled with a material (e.g., a fluid or a solid) that is transparent to microwaves and that is configured to prevent water from entering into the waveguide, or the waveguide may be coated or otherwise be made waterproof in order to prevent water from entering into the waveguide.

The microwave source 20 and/or one or more waveguides 80 may be protected from impact and vibration of drilling by one or more protective structures 90 (e.g., one or more plates) positioned between the microwave source 20 (e.g., one or more microwave generation units) and the rock being drilled (e.g., in front of the microwave source 20 or in the face of the apparatus 10). The protective structure 90 can comprise a material that is substantially transparent to microwave energy (e.g., ceramics and/or plastics, similar to the ceramic plates used in body armor). In certain embodiments, such protective structures (e.g., ceramics and/or plastic plates) protect the one or more microwave generating units while avoiding disruption of the microwaves.

Figure 2:
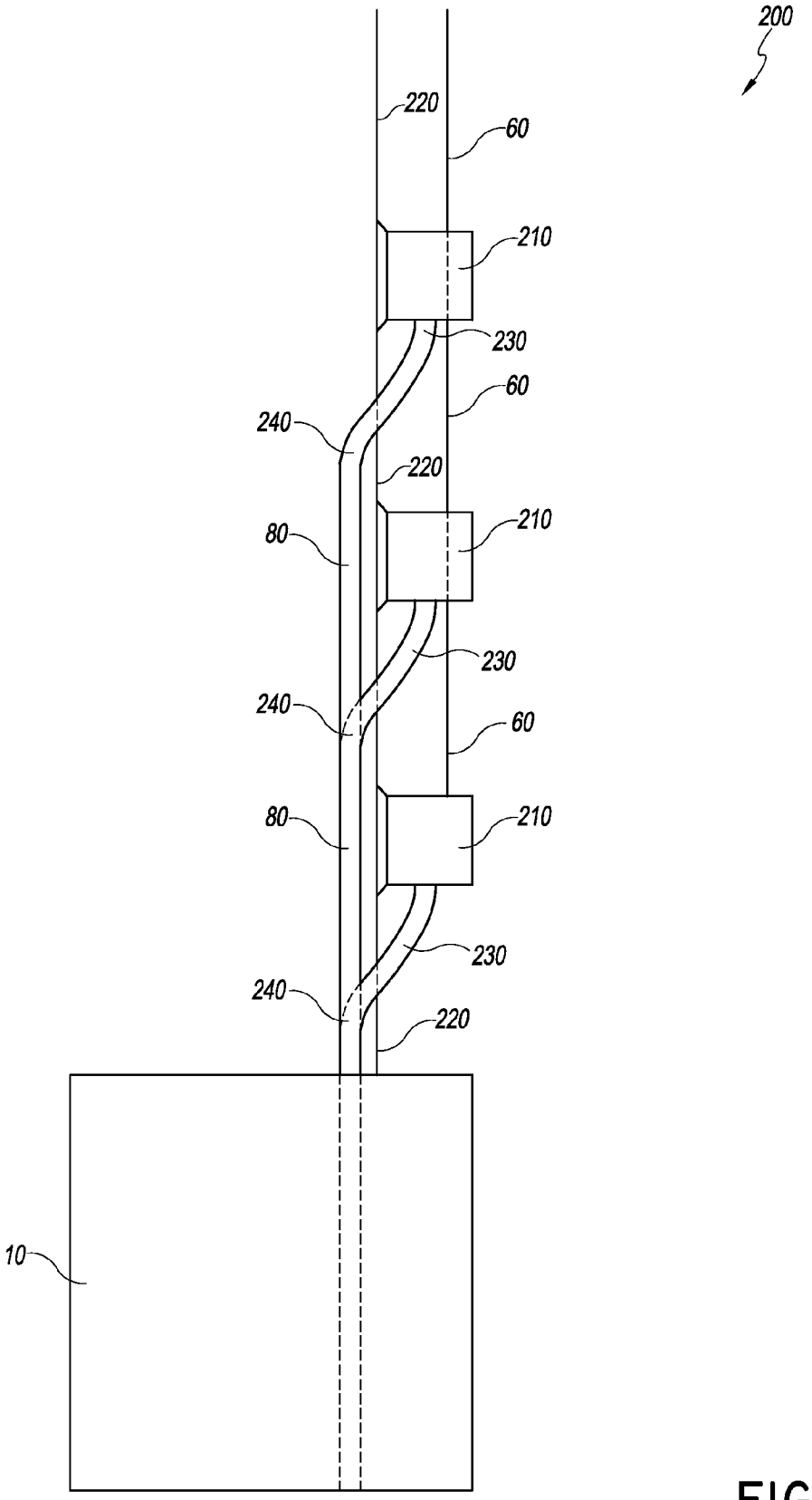
FIG. 2 is a cross-section schematic view of an example drilling system in accordance with certain embodiments described herein.

In some embodiments, the microwave source 20 comprises one or more microwave generation units located outside the apparatus 10. An example of one such embodiment is shown in FIG. 2, which depicts a cross-sectional schematic view of an embodiment of a drill system 200. The drill system 200 may comprise a set of MASERs 210 in pulsed operation, controlled to synchronize their pulses to make sequential use of a single waveguide 80 to convey their microwave energy to the apparatus 10 for use on the rock surface. In certain embodiments, the apparatus 10 is connected to an array of MASERs 210, which produces pulsed emissions of microwaves that are then directed to the apparatus 10 by a single, shared waveguide 80. In certain embodiments, the waveguide 80 and the MASERs 210 rotate with the apparatus 10, and the position of the waveguide 80 and the MASERs 210 in relation to the apparatus 10 is therefore fixed by a support structure and cables 220. (The support structure and cables 220 may also fix the position of other, similar waveguides 80 and MASERs 210 in relation to the apparatus 10 and the waveguide 80 and MASERs 210 illustrated in FIG. 2.) An electric power line 60 conveys the electricity to enable the MASERs 210 to generate the microwaves, and the MASERs are controlled and coordinated by a cable (not shown here, but can be parallel to the electric power line 60) to synchronize the pulses from the MASERs 210 to make sequential use of the single waveguide 80. The MASERs 210 can be connected to the waveguide 80 by waveguide bends 230 and waveguide flanges 240.

In certain embodiments, the pulse widths, duty cycle, and other parameters of pulsed separation can be selected in order to maximize the amount of energy that can be applied to the rock at the bottom of the borehole, subject to the limitations of the waveguide that is used.

Referring again to FIG. 1, the first fluid can comprise seawater. Seawater may be particularly useful when a well is being drilled offshore. The first fluid can be used to chill the hot rock and open up cracks in the rock while also cooling apparatus 10 and related equipment, particularly the cutting structures 70, and/or to jack open cracks in the rock surface using pressure and/or to cut the rock, using high-pressure jets. In some embodiments, the first fluid is configured to alter the material of the rock surface and beneath the rock surface by at least one of the group consisting of: cooling, weakening, fracturing, cutting, and cracking the material. Using seawater as the first fluid can be inexpensive, compared with most of the drilling mud used in conventional drilling, which can facilitate the use of large volumes of the fluid not only to remove rock particles from the borehole, but also to cool the drill bit, the related equipment, and the rock surface. In certain embodiments, the seawater can be as cold as 3° C. and the flow rate can be more than 10 liters per second. In certain embodiments, pumps at the top of the drill string and/or pumps that are operated downhole, in or near the drill bit, can be used to increase the flow rate and/or the pressure of the first fluid.

For example, the first fluid (e.g, the drilling fluid) can be circulated from outside of the borehole through the apparatus 10 (e.g., through the drill bit and drilling fluid jets in the drill bit) to carry or transport the rock particles or debris removed from the surface of the rock out of the borehole. Because seawater is less dense than conventional drilling mud, it can be easier to accelerate the circulation.

To the extent that the temperature of the rock surface is to be cooled, the first fluid can comprise cold seawater. In certain embodiments, the piping or tubing carrying the circulating first fluid to the drill bit can include insulation 100 to keep it cooler, and/or the speed of circulation can be increased, whereby the circulating first fluid takes away the unwanted heat from the drilling region as well as the rock particles, such that the desired decrease in temperature in the rock surface, the apparatus 10 (e.g., the drill bit), and the borehole can be achieved. In some embodiments, the temperature fluctuations resulting from the application of microwave energy from the microwave source 20 (e.g., if the rock surface is hot enough) and subsequent cooling from the first fluid may cause cracks in the rock to develop or open further making it easier to remove the rock.

By heating the rock with one influence (such as penetrating microwave energy) and cooling it with another (such as the first fluid against the rock surface), the apparatus 10 can cause cracking along different axes, thus cross-hatching the rock. In certain embodiments in which drilling fluid jets in the drill bit are used to flood the surface of the rock with a cold first fluid, cracks in the rock can be opened by the chilling of the rock surface. Basalt that is rapidly cooled under such circumstances often cracks into vertical columns, generally hexagonal or square in cross-section, which may be less than one centimeter in diameter if the basalt cooled very rapidly ("columnar basalt"). By heating the rock with one influence (such as penetrating microwaves) and cooling it with another (such as the first fluid against the rock surface), the system may cause cracking along different axes, thus cross-hatching the rock. As the cracks multiply and expand, they can accelerate the distribution of the first fluid into the cracks, and the microwaves can heat the first fluid in the cracks, further expanding the cracks and creating further hot inclusions in the rock. In certain embodiments, jets of fluid can be used to remove rock debris at and near the point of contact between the drill bit rollers and the rock, thus increasing the rate of penetration of the rollers substantially. Moreover, the pressure of the first fluid can be increased by increasing the pressure with which the first fluid is pumped down the drill string or by using a downhole pump in or near the drill bit. Such an increase in pressure can help to propagate, or jack open, cracks in the rock. Just as the effect of the one or more microwave generating units can be adjusted for circumstances by adjusting the frequencies and the power of the microwaves, the effect of the first fluid can be adjusted to increase its cooling effect, by accelerating the circulation, or to increase the hydraulic effect, by increasing the pressure.

In certain embodiments, the first fluid may be used not only to cool the rock and remove pieces of rock, but high-pressure jets can emit the first fluid with sufficient force to cut the rock surface at the bottom of the wellbore. For example, the first fluid (e.g., seawater) can be forced out of the apparatus 10 under high pressure through nozzles or jets 110 located in a header 120. The header 120 and the nozzles 110 can be slightly recessed in order to avoid direct contact with the rock surface. The jets of fluid can be used to remove rock debris at and near the point of contact between the cutting structures 70 and the rock, thus increasing the rate of rock removal. Moreover, the pressure of the first fluid can be increased by increasing the pressure with which the first fluid is pumped down the drill string 50 or by using a downhole pump in or near the drill bit. Such an increase in pressure can help to propagate, or jack open, cracks in the rock. In some embodiments, the first fluid source 30 can be considered to comprise the at least one nozzle 110 configured to emit the first fluid at sufficiently high pressures such that the first fluid cuts the surface of the material.

In certain embodiments, drilling fluid jets 110 are positioned in such a manner as to cause, when they are activated, the apparatus 10 to rotate and/or counter-rotate about an axis. In certain embodiments, the jets 110 can be aimed at an angle from the vertical, either toward or away from the central axis of the apparatus 10, so that the cuts are angled down into the rock face. In certain embodiments, the angle is selected to achieve a particular depth below the surface of the rock at which the cut is intended to intercept another structure (e.g., a cut or a crack in the rock). In certain embodiments, the angle is selected to have the first fluid cut into a depth below the surface of the rock at which the cut is intended to intercept another structure (e.g., a cut or a crack in the rock). In certain embodiments, the angle is selected to cut a trough in the surface of the rock around the central axis of the borehole. In certain embodiments in which the first fluid is used at high pressure, the first fluid can comprise abrasive additives to enhance the cutting of the rock.

The effectiveness of microwaves to transmit energy into the rock at the bottom of the well may be limited (e.g., decreased substantially) if the borehole is flooded with water, because the water may absorb much of the energy from the microwaves as they pass through the water. Accordingly, a second fluid from the second fluid source 40 (e.g., a pressure nozzle or other structure of the drill bit) can be used to at least partially flush (e.g., remove) the water or other first fluid from the space between the apparatus 10 or the cutting structures 70 and the rock surface (e.g., out of the path of the microwaves from the waveguides to the rock surface).

The second fluid can comprise a material that does not appreciably absorb microwave energy (e.g., nitrogen). In some embodiments, the second fluid flushes out the space so that microwave energy from the one or more waveguides 80 can more easily penetrate the rock surface. And in those embodiments in which nitrogen is used as the second fluid and the ambient pressure at the bottom of the borehole is high enough to ensure that the pressure of the nitrogen exceeds the critical pressure for nitrogen (which is approximately 34 bar), the nitrogen can be a critical fluid instead of a gas. In some embodiments, the second fluid source 40 comprises at least one nozzle configured to emit the second fluid at the critical pressure of the second fluid.

In certain embodiments, the second fluid source 40 can comprise a tube of the drill bit (e.g., a tube that is attached and sealed to the outside of the apparatus 10 or that is at least partially within the apparatus 10) and aligned with the directional axis of the waveguides 80. The tube can have a cross-section that has the same shape as the waveguide and dimensions that are configured to convey a sufficient amount of the second fluid to the bottom of the wellbore. For example, the tube can be no smaller in inside measurements than the waveguides 80. In certain embodiments the tube can be constructed of materials that are transparent to microwaves. In certain embodiments, the tube can extend and retract (e.g., telescope) by remote control as needed to reach from the apparatus 10 (e.g., drill bit) to or near the rock surface, thereby conveying the second fluid to or near the rock surface. The force of the expelled second fluid from the second fluid source 40 (e.g., a lower end of the tube) can be sufficient to flush out any portion of the first fluid that remains between the second fluid source 40 (e.g., the lower end of the tube) and the rock face. The second fluid source 40 can be filled and refilled with the second fluid from the drill bit, for example, as the second fluid source 40 is extended, as the second fluid is expelled from the second fluid source 40, or as is otherwise desired. In certain embodiments, the second fluid is nitrogen and it is pressurized to be a liquid or a supercritical fluid. In certain embodiments, the pressure of the second fluid can be increased by increasing the pressure with which the second fluid is pumped down the drill string or by using a downhole pump in or near the drill bit so that the pressure by which the second fluid is expelled from the drill bit can exceed the pressure of the first fluid in front of the drill bit, which can exceed 200 bar.

According to some embodiments, the apparatus 10 further comprises a controller (e.g., a microcontroller, processor, or other computer-based system) configured to sequentially actuate the microwave source 20, the first fluid source 30, and the second fluid source 40 (e.g., to alternatingly heat the rock surface with the microwaves and cooling the rock surface with the first fluid, which is then flushed away by the second fluid). Such a sequential operation may be used to alternatingly expose a particular area of the rock first to one fluid and then to another. In some embodiments, both the first and second fluid are simultaneously emitted from their respective fluid sources at the same time though at different locations. For example, in some embodiments in which the apparatus 10 rotates within the borehole, the first fluid may be emitted at one location as the apparatus 10 rotates, and the second fluid can be emitted at the same time at another location. The rotation of the apparatus 10 can result in the sequential or alternating exposure of any given portion of the rock surface to both fluids even though both fluids may be emitted at the same time. In some cases, the rock surface is cooled by the first fluid, and the rock surface can be more easily heated when exposed to the second fluid since, unlike the first fluid, the second fluid generally does not absorb appreciable quantities of the microwave energy from the microwave source 20.

Because the first fluid typically absorbs at least some of the microwave energy from the microwave source 20 thereby increasing in temperature, in embodiments where the first fluid is to be used as a cooling fluid, it may be beneficial to deactivate the microwave source 20 while the first fluid is used to cool the rock. Accordingly, the controller can be further configured to actuate the microwave source 20 while the second fluid source 40 (e.g., coupled with the microwave source 20) is actuated and to not actuate the microwave source 20 unless the second fluid source 40 is actuated.

In certain embodiments, the microwave energy is directed at the rock surface concurrently with the flow of the second fluid being directed toward the rock surface. In some methods, directing the microwave energy is not performed concurrently with the flow of the first fluid that is directed toward the rock surface. In some methods, directing the first fluid and directing the second fluid are performed sequentially.

In some embodiments, the cutting structures 70 can include any number of different cutting devices, such as grinding areas or rollers, on the face of the drill bit to facilitate additional removal of rock possibly in conjunction with microwaves, the chilling effect of the circulating or drilling fluid, and the cutting jets of drilling fluid ejected from the nozzles 110. The cutting structures 70 may protrude slightly from the face of the apparatus 10, which can reach from the center to the perimeter of the apparatus 10. The cutting structures 70 do not appear to reach the perimeter in the perspective shown in FIG. 1 because the sector depicted does not spread across the full breadth of the face of the apparatus 10 when viewed from the direction of view in FIG. 1. But, from this direction, the cutting surfaces 70 reach the perimeter on the far side of the apparatus 10.

Figure 3:
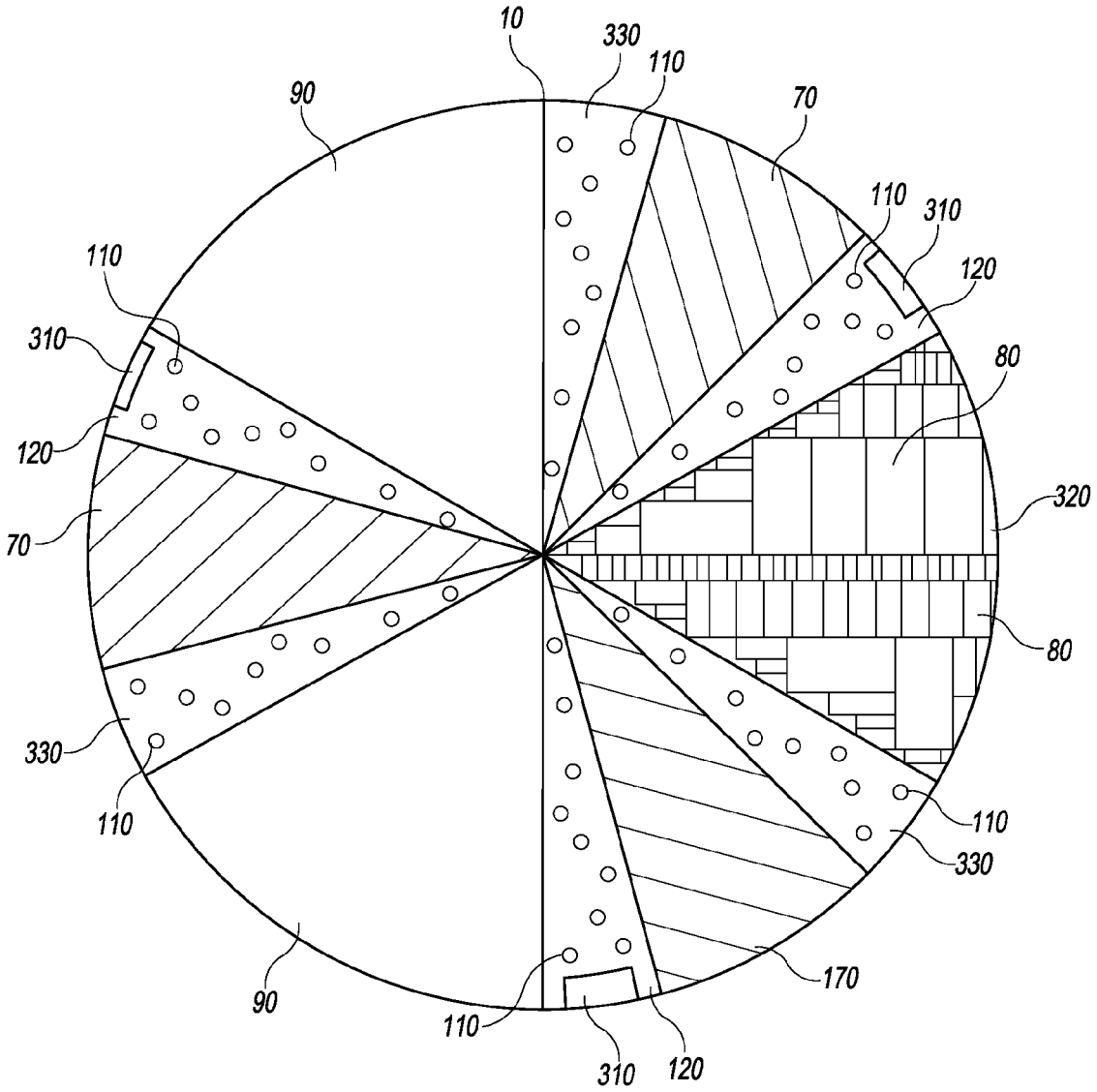
FIG. 3 is a schematic bottom view of the drilling apparatus shown in FIG. 1.
Figure 4:
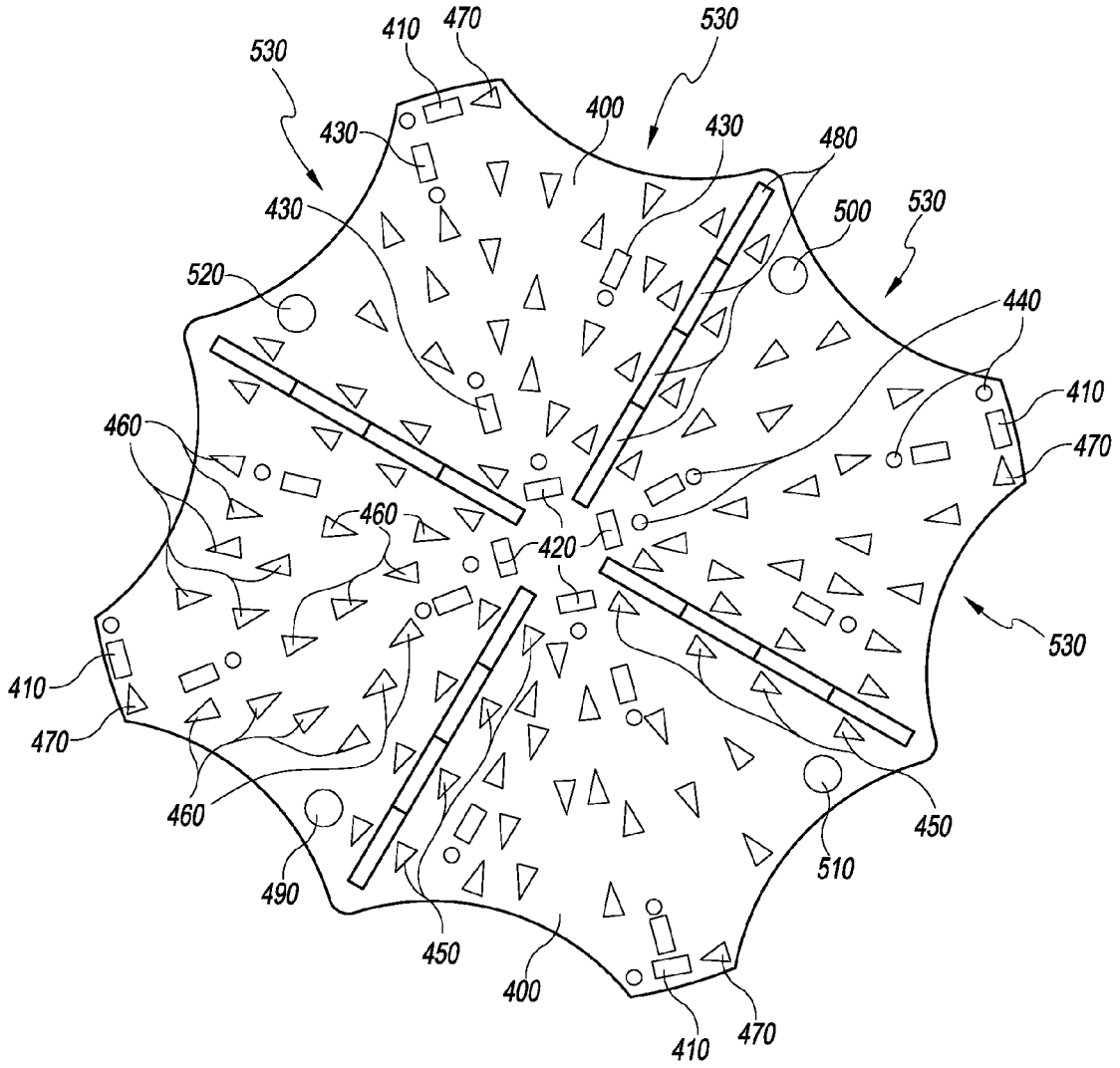
FIG. 4 is a schematic view of bottom view of an alternative example drilling apparatus in accordance with certain embodiments described herein.

For example, the bottom faces of the apparatus 10 can have a pattern of areas passing over the rock surface as the apparatus 10 turns. FIGS. 3 and 4 illustrate examples of such patterns. FIG. 3 shows that each of these areas can comprise one or more of the following: one or more microwave waveguides 80, fluid jets or nozzles 110, cutting structures 70 (e.g., rollers). In certain embodiments, a face of the apparatus 10 can comprise multiple such features. For example, the face may repeat a sequence of one or more microwave waveguides, drilling fluid jets, and cutting structures (e.g., rollers) two or three times so that the first fluid may be applied (e.g., at different pressures) to the rock surface before and/or after the microwaves are applied to cool the rock surface and/or to jack open the cracks and/or to cut the rock. The cutting structures 70 (e.g., grinding areas or rollers) can be bolted to the face of the apparatus 10, so they can be easily replaced without replacing the entire apparatus 10. In certain embodiments, the apparatus 10 can comprise a skeletal framework which vibrationally isolates the cutting structures 70 from at least some other portions of the apparatus 10 to protect these other portions from vibrations and other effects resulting from the contact of the cutting structures 70 with the rock. The share of the drilling that is caused by the cutting structures 70 can be increased by increasing the rotational speed of the apparatus 10. In certain embodiments, the rotational speed of the apparatus 10 can be set to a predetermined level (e.g., slowed) such that the microwave source 20 and the first fluid have more time to affect the rock, and the drilling rate becomes proportionately more of a function of the microwaves and the first fluid.

For example, again referring to FIG. 3, the face of the apparatus 10 can be said to comprise three subsections, each subsection consisting in this embodiment of four sectors. One such sector consists of a header 100 through which drilling fluid can be injected through slightly recessed drilling fluid jets 110 in the face of the apparatus 10. At the outer edge of the header 120 can be a gage cutter 310 to cut a kerf around the perimeter of the rock to be drilled. (In this embodiment, the gage cutter can use microwaves, and the related drilling fluid jet is not shown.)

A similar gage cutter at an outer edge of the apparatus 10 is illustrated in FIG. 1 as utilizing a combination of drilling fluid and microwave energy. The first fluid can be dispensed through a high pressure nozzle 120 that is connected to the first fluid source 30 via a branch 130. Microwave energy can be delivered via a waveguide 140 from a microwave source 150 where the microwave source can be powered by branch 180 that connects to electric power line 60. Similar to the waveguides 80, the waveguide 140 may be protected from the rock surface by a protective structure 160.

Referring again to FIG. 3, the protective structure—which may comprise a ceramic or plastic material—is positioned between the rock surface and the waveguides 80 and the microwave source 20. In one of the three microwave sectors 320, the protective structure 90 has been removed from this sector to show the array of waveguides 80. Note that the variation in sizes of waveguides 80 can be related to a desired wavelength; the smaller waveguides can be for microwaves of shorter wavelength and therefore higher frequency. Adjacent to the protective structure 90 can be another header 330 through which the first fluid can be injected through slightly recessed drilling fluid nozzles 110 in the face of the apparatus 10. Note that these headers 330 do not have a gage cutter at their outer edge although, in some embodiments, they can have a gage cutter. Next to such header 330 can be a cutting structure 70.

Referring now to FIG. 4, another example face of a drilling apparatus is shown in accordance with certain embodiments described herein. The face comprises protective structure 400 protecting the inner contents of the apparatus, in which or through which shield 400 the various drilling functions can operate. The shield 400 can be transparent to microwaves, so the waveguides for the microwaves to be used by the gage cutter 410 for melting the kerf, the waveguides 420 for the melting of the central area of the rock face, and the waveguides 430 for the surface of the rock are behind the shield 400. Each such waveguide is paired with a jet orifice 440 extending from the shield 400 to provide the second fluid (e.g., nitrogen as a critical fluid) to flush the area between the waveguides 420 and the rock. Also extending from the shield 400 are jet orifices 450 to provide the first fluid to clean the rock surface and/or to chill the rock surface and the drill bit, jet orifices 460 to cut the rock, and jet orifices 470 to operate as, or in conjunction with, the gage cutter 410. Set into, and operated through, the shield 400 are rollers 480 to crush areas of the surface rock and to rotate the drill bit as desired, and to gather data on the rock surface to be used in controlling the drilling operation. Also set into, and operated through, the shield are the sender 490 and the receiver 500 for ground penetrating radar, and the sender 510 and the receiver 520 for sonar, to provide additional data for controlling the drilling operation. Thermometers and other, additional instrumentation (not shown) to provide data for controlling the drilling operation can be set into, and/or operated through, the shield 400. Openings 530 around the shield 400 can be provided to allow for the return of the first fluid and rock pieces past the outside of the drill bit and up the borehole.

As illustrated in FIG. 4, in certain embodiments, the apparatus 10 can comprise one or more treaded rollers 480 configured to crush the rock surface. For example, the rollers 480 can be arranged along one or more lines extending from the center of the borehole (or from the edge of the pit at the center of the borehole, if the borehole has such a pit) to the outer edge of the drilling apparatus (or to the edge of the kerf at the edge of the borehole, if the borehole has such a kerf). The one or more rollers 480 can be connected to one or more motors that turn the rollers 480, so that the rollers 480 can cause the drilling apparatus to rotate and/or counter-rotate.

Certain embodiments described herein are configured to drill part or all of the borehole by using the microwaves (e.g., generated by MASERs) to raise the temperature of the rock surface above the melting point sufficiently to make the rock liquid. Drilling fluid jets in the apparatus 10 can direct jets of the first fluid, which may be propelled in high-pressure pulses, at the area of molten rock in order to cut or blast the molten rock into droplets moving away from the surface of the rock. The cooler first fluid can cause the droplets to solidify into pebbles which are carried up the borehole by the circulating fluid. Certain such embodiments do not use any cutting structures (e.g., grinding faces) to remove the rock and do not directly contact the rock surface. This approach may be particularly advantageous for drilling rock that is already at a very high temperature.

In certain embodiments, more than one microwave waveguide can be directed at the center of the rock face from various angles, so that the microwaves pass through the center of the rock surface but thereafter proceed into various areas of the subsurface rock (depending on the angle). In certain embodiments, the microwaves thus heat a number of areas of the subsurface rock and combine to heat the center of the surface past the melting point, so that it can be removed by high-pressure jets of nitrogen or another fluid, leaving space for the release of compressive force and the expansion, and fracturing, of the surface rock. In certain other embodiments, the multiple waveguides can each be directed to the same region, thereby creating a concentrated region of microwaves, which melts the rock in the region. In certain embodiments, the first fluid or the second fluid can be used to push or force the molten rock away, leaving a depression. This depression can serve as a region in which the surrounding rock can expand laterally and crack.

In certain embodiments, the actions of the drilling apparatus can be controlled by a person, a computer processor, or both. In certain embodiments, the apparatus 10 further comprises a computer processor (e.g., controller) configured to continually monitor the surface of the rock so that the drilling apparatus is not advanced further into the borehole if the face of the drilling apparatus would touch the rock. The controller can cause the drilling apparatus to reverse back and forth across any high spot in the rock and cut (e.g., using drilling fluid jets 460) or crush (e.g., using rollers 480) the high spot to the extent desired to enable the drilling apparatus to advance further in the borehole. If the face of the drilling apparatus does contact the rock, the controller can cause the drilling apparatus to be raised sufficiently to avert such contact.

Certain embodiments described herein can be equipped to monitor the cracking of the rock, the temperature of the rock, and the drilling fluid. Certain such embodiments advantageously enable more precise and effective use of the various methods of drilling by adjusting the functions of the drilling apparatus, including the use of frequencies and power in the microwave units, cooling and pressure in the drilling fluid, and speed and direction of the rotation of the drilling apparatus to optimize the drilling. Such equipment can include radar (sender 490 and receiver 500) and/or sonar (sender 510 and receiver 520) to scan the rock surface, and can include ground penetrating radar to acquire data on the condition of the rock below the rock surface. The ability to use a variety of modalities to break down the rock, instead of simply grinding or cutting it, reduces the amount of impact, and therefore the wear and tear, on the drilling apparatus and other drilling equipment.

In certain embodiments, the apparatus 10 can include one or more gage cutters 410 in the outer edge of the drilling apparatus 10, configured to cut a narrow kerf in the rock surface at the perimeter of the borehole that is to be drilled. Such a kerf can relieve lateral confinement, and can make it easier for cracks to propagate in the rock that is to be removed from the borehole, while reducing the tendency for cracks created in the rock that is to be drilled from spreading into the rock that is to be outside the borehole. The one or more gage cutters 410 can comprise one or more of the following: a mechanical gage cutter (such as the ones commonly used), a fluid jet cutter, and one or more sources of high-frequency energy, high-energy microwaves sufficient to melt rock in a thin, narrow band at the rock surface on the perimeter of the borehole (such as was discussed above with reference to FIG. 1). In certain embodiments, the drilling apparatus can also use drilling fluid jets 470 near and in conjunction with a microwave gage cutter 410, aimed to force molten rock created by the microwave gage cutter 410 into the cracks in the rock outside the borehole and thus strengthen the wall of the borehole. Such drilling fluid jets 470 can also be used to wet the rock at which a microwave gage cutter 410 is aimed, to help the rock melt. The microwave waveguides of the gage cutter 410 can be angled slightly away from the axis of the borehole so the upper part of the kerf is cut (as the drilling apparatus is turned) at the inside diameter of the kerf, and the lower part of the kerf is cut at the outside diameter of the kerf. By angling the microwave gage cutter 410 outward from the side of the drill bit, the kerf can be made wider than the drilling apparatus so that there can be no part of the drilling apparatus that extends laterally as far as the wall of the borehole.

Thus, certain embodiments of the present application, as described above, can provide a system and method for drilling in hard, hot rock that is more cost and time effective than traditional drilling methods that take longer to drill hard rock and are more susceptible to drill bit wear at the high temperatures of the hot rock.

Figure 5:
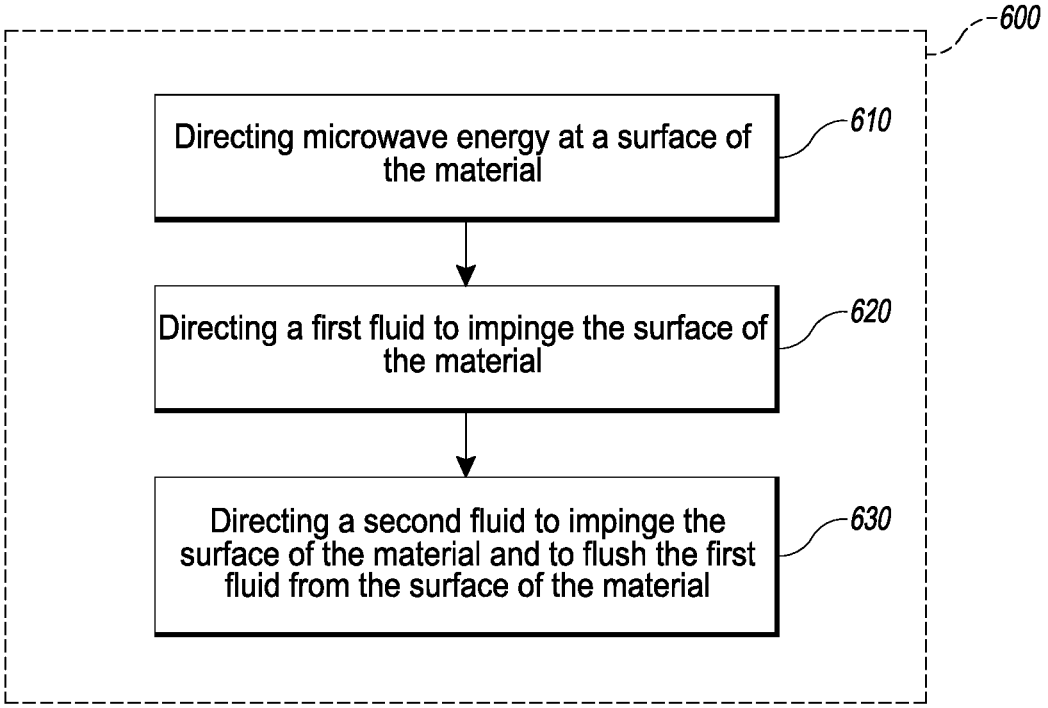
FIG. 5 is a flowchart of an example method for drilling a wellbore in a material comprising rock in accordance with certain embodiments described herein.

FIG. 5 is a flow diagram of an example method 600 for drilling a wellbore in a material comprising rock in accordance with certain embodiments described herein. In an operational block 610, the method 600 comprises directing microwave energy at a surface of the material. In an operational block 620, the method 600 further comprises directing a first fluid to impinge the surface of the material. The first fluid is substantially absorptive to the microwave energy. In an operational block 630, the method 600 further comprises directing a second fluid to impinge the surface of the material and to flush the first fluid from the surface of the material. The second fluid is substantially transparent to the microwave energy.

Various embodiments of the present application have been described above. Although some embodiments of the application have been described with reference to these specific embodiments, the descriptions are intended to be illustrative of some of the embodiments of the present disclosure and are not intended to be limiting. Various modifications and applications may occur to those skilled in the art without departing from the true spirit and scope of the application as defined in the appended claims.

What is claimed is:

1. A method of drilling a wellbore in a material comprising rock, the method comprising:

directing microwave energy at a first region of a surface of the material to alter the material in the first region;

directing a first fluid to impinge the first region and to alter the material in the first region, wherein the first fluid is substantially absorptive to the microwave energy; and directing a second fluid to impinge the first region and to flush the first fluid from the first region, wherein the second fluid is substantially transparent to the microwave energy, wherein (i) said directing the first fluid to impinge the first region and said directing the second fluid to impinge the first region are performed sequentially to one another, (ii) said directing the second fluid to impinge the first region is performed concurrently with said directing the microwave energy at the first region, and (iii) said directing the first fluid to impinge the first region is not performed concurrently with said directing the microwave energy at the first region.

2. The method of claim 1, further comprising:

concurrently directing the second fluid and the microwave energy at a second region of the surface of the material, the second region different from the first region; and directing the first fluid to impinge the second region to alternately expose the second region to the first fluid and the second fluid;

wherein said directing the first fluid to impinge the second region is performed concurrently with directing the second fluid to impinge the first region.

3. The method of claim 1, wherein said directing the microwave energy comprises altering the material by at least one of the group consisting of: heating, softening, increasing fluid permeability, weakening, fracturing, melting, and cracking the material.

4. The method of claim 1, wherein said directing the first fluid comprises altering the material by at least one of the group consisting of: cooling, weakening, fracturing, cutting, and cracking the material.

5. The method of claim 1, wherein said directing the first fluid comprises transporting debris away from the surface of the material.

6. The method of claim 1, wherein said directing the first fluid comprises emitting the first fluid at sufficiently high pressures wherein the first fluid cuts the surface of the material.

7. The method of claim 1, further comprising forming a kerf by using the microwave energy to melt a band of rock in a perimeter of the wellbore and using the first fluid to force the melted rock into cracks in rock outside the wellbore.

8. The method of claim 1, further comprising alternately exposing a second region of the surface of the material to the second fluid while being concurrently irradiated by the microwave energy and exposing the second region to the first fluid while not being concurrently irradiated by the microwave energy, the second region different from the first region, the second region being exposed to the first fluid concurrently with the first region being exposed to the second fluid.

9. The method of claim 1, wherein directing microwave energy comprises generating the microwave energy using a microwave source comprising at least one microwave generator and at least one waveguide configured to direct the microwave energy from the at least one microwave generator towards the material.

10. The method of claim 9, wherein the at least one microwave generator is configured to be within the wellbore, and further comprises a protective structure positioned between the at least one waveguide and the surface of the material, the protective structure configured to protect the at least one microwave source and the at least one waveguide from contact with the surface of the material, wherein the protective structure is substantially transparent to the microwave energy.

11. The method of claim 9, wherein the microwave source comprises one or more microwave amplification by stimulated emission of radiation (MASER) devices.

12. The method of claim 11, wherein the microwave source comprises a plurality of MASER devices configured to generate microwave energy having different wavelengths.

13. The method of claim 1, wherein the first fluid comprises seawater.

14. The method of claim 1, wherein the second fluid comprises nitrogen.

15. The method of claim 1, directing the second fluid comprises emitting the second fluid from at least one nozzle at the critical pressure of the second fluid.

* * * * *